US010696055B2

(12) United States Patent
Rietbergen et al.

(10) Patent No.: US 10,696,055 B2
(45) Date of Patent: Jun. 30, 2020

(54) INK BOTTLE CLOSURE, INK BOTTLE, AND ASSOCIATED DISPENSING DEVICE

(71) Applicant: Océ Holding B.V., Venlo (NL)

(72) Inventors: Mark Rietbergen, Venlo (NL); Joseph A. Schulkes, Venlo (NL); Bas Smeets, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/441,619

(22) Filed: Jun. 14, 2019

(65) Prior Publication Data

US 2019/0291450 A1 Sep. 26, 2019

Related U.S. Application Data

(62) Division of application No. 15/785,018, filed on Oct. 16, 2017, now abandoned.

(30) Foreign Application Priority Data

Oct. 17, 2016 (EP) ..... 16194244

(51) Int. Cl.

| | |
|---|---|
| ***B41J 2/175*** | (2006.01) |
| ***B43L 25/00*** | (2006.01) |
| ***B65D 51/20*** | (2006.01) |

(52) U.S. Cl.

CPC ..... *B41J 2/17536* (2013.01); *B41J 2/17506* (2013.01); *B41J 2/17553* (2013.01); *B43L 25/002* (2013.01); *B65D 51/20* (2013.01)

(58) Field of Classification Search

None

See application file for complete search history.

(56) References Cited

U.S. PATENT DOCUMENTS

| | | | |
|---|---|---|---|
| 3,207,375 | A | 9/1965 | Bereziat et al. |
| 4,127,212 | A | 11/1978 | Waterbury |

(Continued)

FOREIGN PATENT DOCUMENTS

| | | | |
|---|---|---|---|
| EP | 1671568 | A2 | 6/2006 |
| JP | 2004-99082 | A | 4/2004 |

(Continued)

*Primary Examiner* — Shelby L Fidler

(74) *Attorney, Agent, or Firm* — Birch, Stewart, Kolasch & Birch, LLP

(57) ABSTRACT

A system including an ink bottle closure including a first closure member configured to be fixed to an ink bottle, the first closure member including a seal, arranged to be located over an outlet opening in a neck of the bottle and a second closure member attached to the first closure member and movable relative to the first closure member between a closed position, in which the second closure member covers the seal, and an open position in which the seal is exposed to be pierced or ruptured for dispensing ink from the bottle through the outlet opening, wherein the second closure member is movable in translation, relative to the first closure member between the closed position and the open position in a direction substantially perpendicular to a central or longitudinal axis of the bottle and a dispensing device for opening an ink bottle closure, including an adapter having a receiving area for receiving the ink bottle closure of an ink re-fill bottle with the bottle in an inverted orientation, a mechanism for moving the second closure member relative to the first closure member from a closed position, in which the second closure member covers the seal, to an open position in which the seal is exposed and a cutter arranged below the adapter substantially aligned with the receiving area, wherein the cutter is movable generally vertically between a lower position, in which the cutter is retracted from interaction with the ink bottle closure, and an upper (Continued)

position in which the cutter pierces or ruptures the exposed seal to dispense ink from the bottle.

16 Claims, 4 Drawing Sheets

(56) References Cited

U.S. PATENT DOCUMENTS

| | | | | |
|---|---|---|---|---|
| 4,243,150 | A | 1/1981 | Gunne et al. | |
| 4,570,817 | A | 2/1986 | Hambleton et al. | |
| 2005/0011916 | A1* | 1/2005 | Battista | B41J 2/17523 222/576 |
| 2006/0124662 | A1* | 6/2006 | Reynolds | B41J 2/17506 222/23 |
| 2006/0138145 | A1 | 6/2006 | Toth et al. | |
| 2013/0249978 | A1 | 9/2013 | Wegman et al. | |
| 2013/0271536 | A1 | 10/2013 | Kondou et al. | |
| 2014/0255058 | A1* | 9/2014 | Salomons | G03G 15/0881 399/106 |
| 2016/0311583 | A1 | 10/2016 | Banning et al. | |

FOREIGN PATENT DOCUMENTS

| | | | |
|---|---|---|---|
| JP | 5311040 | B2 | 10/2013 |
| WO | WO 93/18920 | A1 | 9/1993 |
| WO | WO 99/04979 | A1 | 2/1999 |

* cited by examiner

INK BOTTLE CLOSURE, INK BOTTLE, AND ASSOCIATED DISPENSING DEVICE

CROSS-REFERENCE TO RELATED APPLICATIONS

This application is a Divisional of U.S. patent application Ser. No. 15/785,018, filed on Oct. 16, 2017, which claims priority under 35 U.S.C. § 119 to application Ser. No. 16/194,244.6, filed in Europe on Oct. 17, 2016, all of which are hereby expressly incorporated by reference into the present application.

BACKGROUND OF THE INVENTION

1. Field of the Invention

The present invention relates to an ink bottle closure, especially a closure for an ink re-fill bottle. The present invention also relates to an ink bottle that includes such an ink bottle closure. Furthermore, the present invention relates to a device for opening the ink bottle to dispense the ink contained therein.

2. Background of the Invention

In printing or copying systems, and especially in inkjet-based printing or copying systems, ink refill arrangements are used for refilling an ink storage reservoir of a printer or copier. Ink is therefore typically supplied from an ink bottle, which usually is configured as a re-fill bottle, into the ink storage reservoir.

A storage reservoir filling mechanism and an ink bottle closure are provided that permit establishment of a flow communication between an interior of the ink bottle and the ink reservoir without permitting the ink to spill or escape and thereby soil or contaminate the equipment or come into contact with an operator. Furthermore, it should be avoided that the liquid ink remains on any external surfaces of the ink storage reservoir or the ink bottle when the refilling process has been completed.

SUMMARY OF THE INVENTION

In view of the above, it is an object of the present invention to provide a new and improved ink bottle closure and an ink bottle having such a closure. It is also an object of the present invention to provide a new and improved filling or dispensing device for opening the bottle to dispense the ink contained therein.

According to one aspect, the present invention provides an ink bottle closure, and especially a closure for an ink re-fill bottle. The ink bottle closure comprises a first closure member configured to be fixed to an ink bottle, especially to a neck of the bottle, wherein the first closure member includes a seal, especially an integrally formed seal, arranged to be located over an outlet opening of the bottle. Further, the ink bottle closure comprises a second closure member attached to the first closure member and movable relative to the first closure member between a closed position, in which the second closure member covers the seal, and an open position in which the seal is exposed to be pierced or ruptured for dispensing ink from the bottle through the outlet opening.

In this way, the invention provides an ink bottle closure with which the second closure member can be moved or retracted to an open position to expose the seal for piercing or rupturing to form an outlet port there-through for filling or re-filling an ink storage reservoir, and then moved back to the closed position to cover the outlet port which is then contaminated with ink residue after the filling or re-filling procedure. Accordingly, the ink bottle closure is configured to minimize spillage or escape of ink after a filling or re-filling procedure, thereby avoiding contamination or soiling of the equipment with the ink reside and/or contact with an operator.

In this regard, the second closure member is preferably movable in translation, and especially by sliding, relative to the first closure member between the closed position and the open position. In particular, the second closure member may be preferably configured for movement in a direction substantially perpendicular to a central or longitudinal axis of the bottle. The second closure member may thus be drawn or slid open to expose the seal to be pierced or ruptured for dispensing the ink and then drawn or slid closed to cover and secrete the outlet port with the ink residue. The second closure member may thus comprise a cover element which is mounted on or attached to the first closure member for sliding movement between the closed and open positions. To this end, the cover element may be mounted in one or more slots or grooves formed in the first closure member or, alternatively may define one or more slots or grooves for receiving the first closure member. In either case, the one or more slots or grooves define the path of movement of the second closure member between the closed and open positions.

In a preferred embodiment, the first closure member includes a first lip or rim which extends circumferentially upstanding around the seal to inhibit or prevent migration of ink residue radially outwardly from said lip or rim. As such, the first lip or rim forms a physical barrier to the ink residue or ink droplets accumulating at the outlet port formed through the seal from flowing radially outwards across the closure. Instead, the ink residue or droplets are halted or re-directed by the upstanding lip or rim. This first lip or rim preferably has a generally ring shape or annular configuration.

In a preferred embodiment, a space or gap is provided between the first lip or rim (and particularly a free edge thereof) and an inner surface of the second closure member, when the second closure member is in the closed position. In this way, the space or gap can prevent a droplet of ink residue, which collects on the edge of the first lip or rim after the ink dispensing procedure, from coming into contact with the second closure member, when it is moved or slid back to the closed position to cover the ruptured and contaminated seal. The space or gap is preferably selected to be greater than the typical size or length of an ink droplet, which will, in turn be influenced by the surface tension and viscosity of the ink, as well as the wetting properties of the material from which the first closure member is formed. However, the space or gap is preferably at least about 2 mm, more preferably at least about 4 mm, and typically in the range of about 5 mm to about 10 mm.

In a preferred embodiment, the first closure member includes a second lip or rim which extends circumferentially upstanding around the seal radially outwards from the first lip or rim for inhibiting migration of ink radially outwards. In this regard, the second lip or rim extends generally parallel to the first lip or rim and is typically concentrically arranged having approximately the same height. The second lip or rim cooperates with the first lip or rim to define a trough or channel there-between which may act to catch ink migrating radially outwards and/or to prevent or inhibit such ink migration.

In a preferred embodiment, the first closure member includes a connecting portion which is configured for fixing the first closure member to the bottle, particularly to a neck of the bottle. In this regard, the connecting portion has connecting elements for interaction with complementary connecting elements provided on the bottle. In one example, the respective connecting elements may be configured for a snap-fit engagement. In another example, the connecting elements provided on the first closure member may be configured for a rotary engagement, especially threaded engagement, with the complementary connecting elements on the bottle.

In a preferred embodiment, the first closure member includes a skirt portion that depends from and/or at least partially surrounds the connecting portion. The skirt portion comprises at least one skirt element extending circumferentially around the connecting portion. The skirt portion may, for example, comprise two generally concentric, radially spaced skirt elements which extend circumferentially around the connecting portion. Where the connecting portion is designed for threaded or rotary engagement with the bottle and where locking elements are provided to prevent removal of the first closure member from the bottle, the skirt element(s) of the skirt portion may act or operate to prevent disengagement or unlocking of the locking elements through deformation of the connecting portion. To this end, the skirt element(s) of the skirt portion effectively isolate(s) the connecting portion from a manual deforming force applied by an operator.

In a preferred embodiment, the seal comprises an element integrally formed in the first closure member which defines an outlet port for dispensing ink from the bottle. That is, the seal typically defines a region, especially a line of weakness, which is configured to be cut, pierced or ruptured to open the outlet port. The first closure member is preferably a molded plastic component and the seal may be integrally molded as a membrane or wall element from the same material for covering and sealing the outlet opening of the bottle. For example, the material of the closure may be selected from the group comprising polypropylene (PP) and polyethylene (PE), such as HDPE. These materials are known for good ink resistance and are generally used for bottles and caps.

According to another aspect, the present invention provides an ink bottle having an ink bottle closure according to any one of the embodiments described above. In use, the ink bottle will typically be filled with a liquid ink.

In a preferred embodiment, the ink bottle further comprises an RFID chip storing data identifying one or more characteristics of an ink contained in the bottle, such as ink type, ink color, and/or ink expiry date. In this way, the invention provides an ink bottle which is configured to carry data in a digital format which is readable by a printer or copier into which the ink is to be filled.

According to a further aspect, the present invention provides an ink dispensing device for opening an ink bottle closure according to any one of the embodiments described above in or on a printer or copier. The dispensing device comprises: an adapter having a receiving area for receiving the ink bottle closure of an ink re-fill bottle with the bottle in an inverted orientation; a mechanism for moving the second closure member relative to the first closure member from a closed position, in which the second closure member covers the seal, to an open position in which the seal is exposed; and a cutter arranged below the adapter substantially aligned with the receiving area. The cutter is movable generally vertically between a lower position, in which the cutter is retracted from interaction with the ink bottle closure, and an upper position in which the cutter pierces or ruptures the exposed seal to dispense ink from the bottle. It will be noted that the cutter may only be movable to the upper position when the second closure member is in the open position.

In a preferred embodiment, the cutter comprises a cutting blade provided on or arranged in a channel member defining a fluid path for flow of ink from the bottle into an ink storage reservoir of the printer or copier. The cutting blade preferably has an arcuate cross-section which generally corresponds to a shape or form of the channel member.

In a preferred embodiment, the ink dispensing device comprises a controller for enabling or disabling movement of the mechanism and/or movement of the cutter in dependence on the presence of an ink bottle closure in the receiving area of the adapter and/or in dependence on identification data provided from the ink bottle or the closure. In this regard, the controller is preferably configured to detect and/or to read an RFID chip storing data which identifies one or more characteristics of an ink contained in the bottle, such as ink type, ink color, and/or ink expiry date.

In a preferred embodiment, the ink dispensing device further includes an actuator, such as a lever or button, for manual actuation by an operator to activate or start movement of the mechanism and/or the cutter. As noted above, usually the cutter will only be enabled for movement to the upper position when the second closure member is in the open position. The controller is preferably configured to enable and/or to disable the actuator.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
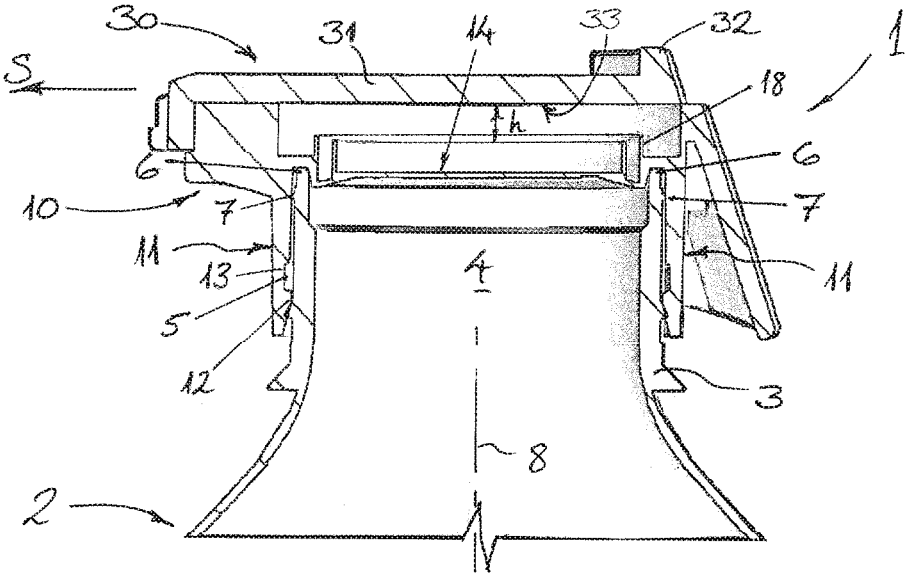
FIG. 1 is a schematic cross-sectional side view of part of an ink bottle with an ink bottle closure according to an embodiment of the invention in a closed position.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF THE PREFERRED EMBODIMENTS

The present invention will now be described with reference to the accompanying drawings, wherein the same or similar elements are identified with the same reference numeral.

With reference firstly to FIG. 1 of the drawings, a cross-sectional view of an ink bottle closure 1 attached to a bottle 2 is shown schematically in a closed position. The bottle closure 1 and an associated dispensing device, described later below, are thus related to an ink supply system for a printer, where the ink needs to be drained quickly (i.e. within seconds) from the bottle 2 into an ink storage reservoir (not shown). In this embodiment, the ink bottle closure 1, which may be generally referred to as a "cap", has two main parts; namely, a first closure member 10 and a second closure member 30.

The first closure member 10 is configured to be fixed to a neck 3 of the ink bottle 2 having an outlet opening 4 for dispensing ink from the ink bottle. To this end, the first closure member 10 includes a connecting portion 11, which is configured for fixing the first closure member 10 to the neck 3 of the bottle 2. In this regard, the connecting portion 11 has connecting lugs 12 or recesses 13 for interaction with complementary connecting elements 5 provided on the bottle. In this embodiment example, the respective connecting elements 5, 12, 13 are configured for a snap-fit engagement with one another. A liquid-tight seal is then formed between the first closure member 10 and the neck 3 of the bottle by means of contact at an upper rim 6 and a sealing bead 7 that extends circumferentially around the neck 3. In this way, the mating engagement between the cap 1 and neck 3 provides the necessary liquid-tight closure. The first closure member 10 (or "first cap member") includes an integrally formed seal 14 in the form of a membrane or a wall element, which is arranged to extend over the outlet opening 4 in the neck 3 of the bottle 2. The bottle 2 can be filled in a production line, after which the closure or cap 1 may simply be pressed on. There is no need for additional ultrasonic welding or heat sealing of a separate foil.

The second closure member 30 (or "second cap member") comprises a generally robust, flat cover element 31, which is attached to the first cap member 10 and is movable relative to the first cap member 10 in a direction generally transverse or perpendicular to a central or longitudinal axis 8 of the bottle 2 between a closed position (shown) and an open position. In the closed position shown in FIG. 1, the second cap member 30 cooperates with the first cap member 10 to cover and to protect the relatively thin, integrally formed seal 14 against inadvertent puncture or rupture. In this example, second cap member 30 is movable in translation, e.g. by sliding, in the direction of arrow S relative to the first cap member 10 from the closed position to an open position. To this end, the cover element 31 may be mounted in one or more slots or grooves (not shown) formed in the first cap member or, alternatively may itself define one or more slots or grooves (not shown) for receiving the first cap member 10, whereby the one or more slots or grooves define the path of movement of the second cap member 30 between the closed and open positions. As will become apparent from the following description, the second cap member 30 includes a projection or ridge 32 which is engaged by and cooperates with a slider mechanism in a dispensing device 100 for moving the second cap member 30 between the closed and open positions. In the open position, the flat cover element 31 is retracted and the seal 14 is exposed to be pierced or ruptured for dispensing ink from the bottle 2 through the outlet opening 4.

With reference now to FIGS. 2 to 6 of the drawings, an interaction between the ink bottle closure or cap 1 attached to the ink bottle 2 and a dispensing device 100 according to an embodiment of the invention will be described in more detail. The dispensing device 100 comprises an adapter 101 having a receiving area 102 for receiving the ink bottle closure or cap 1 of an ink re-fill bottle 2 with the bottle in an inverted orientation; i.e. upside-down so that the ink may simply drain from the bottle 2 under gravity. The dispensing device 100 further comprises a slider mechanism 103 for moving the second cap member 30 relative to the first cap member 10 in the direction of arrow S from the closed position shown in FIG. 2, in which the second cap member 30 covers the seal 14, to the open position shown in FIG. 3, in which the seal 14 is exposed. As noted above, the projection or ridge 32 at the periphery of the cover element 31 of the second cap member 30 may be received in a complementary recess 104 in a base of a tray 105 of the slider mechanism 103. Thus, as the tray 105 moves, it engages and draws the second cap member 30 with it relative to the first cap member 10, which remains fixed in the receiving area 102.

The dispensing device 100 also includes a cutter 106 arranged below adapter 101 substantially aligned with the receiving area 102 directly below the seal 14 when the bottle closure or cap 1 is inserted in the adapter 101. The cutter 106 comprises a cutting blade or knife 107 provided on a channel member 108 which communicates with an ink storage reservoir (not shown) and forms a fluid path for flow of ink from the bottle 2 into that ink storage reservoir of the printer. The cutting blade or knife 107 has an arcuate cross-section, which generally corresponds to a cross-sectional shape of the channel member 108. The cutter 106 is movable in a vertical direction between a lower position shown in FIG. 3, in which it is retracted from interaction with the bottle closure or cap 1, and an upper position shown in FIG. 4 in which it pierces or ruptures the exposed seal 14 to release the ink from the bottle 2. Thus, when the cutter 106 is in this upper position, the ink flows out of the bottle under gravity and through the channel member 108 into the ink storage reservoir (not shown). Naturally, it will be appreciated that the cutter 106 may only move to the upper position in FIG. 4 when the second cap member 30 has been moved via the slider mechanism 103 to the open position. Indeed, movement of the cutter 106 may optionally be disabled until the second cap member 30 has been moved into the open position.

To this end, the dispensing device 100 typically comprises a controller (not shown) for enabling and/or disabling movement of the slider mechanism 103 and/or for enabling and/or disabling movement of the cutter 106. In this regard, the enabling and/or disabling may depend on detecting the presence of an ink bottle closure or cap 1 in the receiving area 102 of the adapter 101. Alternatively, or in addition, the enabling and/or disabling may depend on identification data provided from the ink bottle 2 or the cap 1. For example, the controller may be configured to detect and/or read an RFID chip (not shown) provided on the bottle 2, which stores data identifying one or more characteristics of an ink contained in the bottle, such as ink type, ink color, and/or ink expiry date. In this way, if the wrong type of ink, or the wrong color ink, or ink which has passed its expiry date is mounted in the receiving area 102 to dispense into the reservoir, the controller may detect this and disable the slider mechanism 103 and/or the cutter 106 to prevent erroneous filling of the ink storage reservoir.

The dispensing device 100 typically further includes an actuator 109, such as a lever or button, for manual actuation by an operator to activate or start movement of the slider mechanism 103 and/or the cutter 106. As noted above, usually the cutter 106 will only be enabled for movement to the upper position when the second cap member 30 is in the open position. The controller may therefore be configured to enable and/or to disable the actuator 109.

Figure 2:
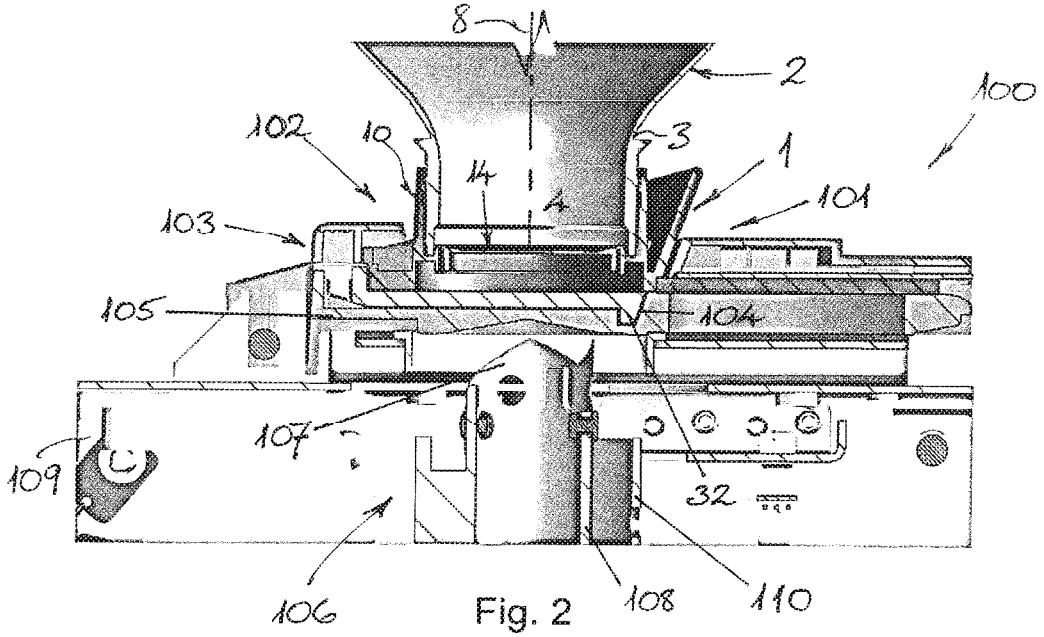
FIG. 2 is a schematic cross-sectional side view of the ink bottle closure of FIG. 1 mounted on a dispensing device according to an embodiment of the invention for opening the closure, with the second closure member in the closed position and the cutter in the lower position.
Figure 3:
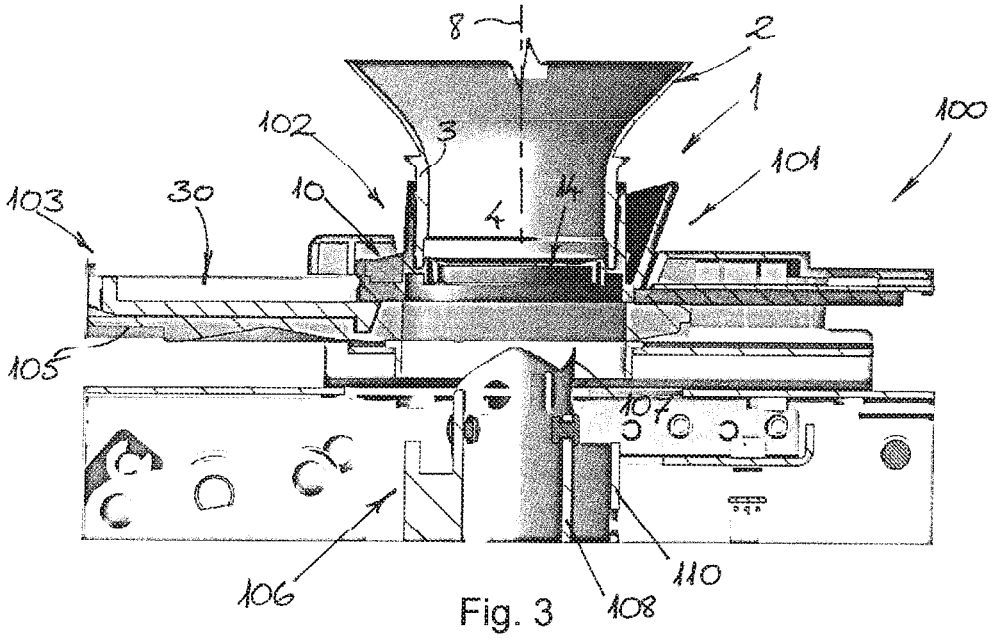
FIG. 3 is a cross-sectional side view of the ink bottle closure of FIG. 1 on the dispensing device of FIG. 2, with the second closure member in the open position and the cutter in the lower position.

The sequence of operation of the dispensing device 100 for filling or refilling the ink storage reservoir is as follows:

(1) The bottle 2, with closed second cap member 30 and an intact seal 14 in the first cap member 10, is inserted into the receiving area bay 102 in the adapter 101 (see FIG. 2). The ink-wetted parts of the printer are set below and covered by the slider mechanism 103, thus preventing contact with an operator.

(2) An RFID chip on the bottle 2 is detected and read by the controller. If the RFID data is approved, a lock moves aside and the operator can actuate a handle 109 which drives the slider mechanism 103. If the data is not approved, the handle 109 is disabled to prevent the filling or re-filling of the printer reservoir with the incorrect ink.

(3) The tray 105 of the slider mechanism 103 and the second cap member 30 are moved simultaneously to the left by the slider mechanism 103. In this way, the seal 14 in the first cap member 10 is exposed to the blade or knife 107 of the cutter 106 (see FIG. 3). At the same time, the bottle 2 is locked in place so that it cannot be taken out and it stands firmly in position.

Figure 4:
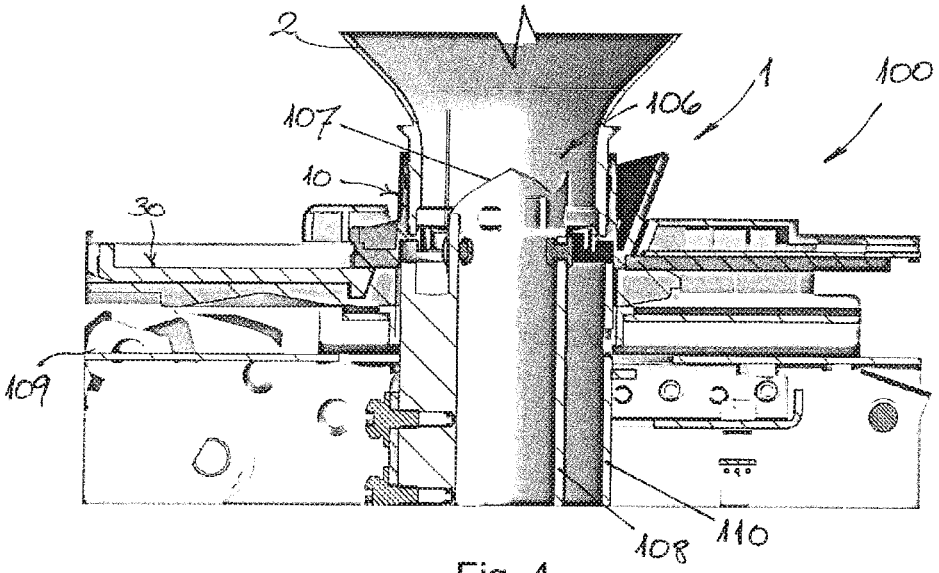
FIG. 4 is a cross-sectional side view of the ink bottle closure of FIG. 1 on the dispensing device of FIG. 2, with the second closure member in the open position and the cutter in the upper position.
Figure 5:
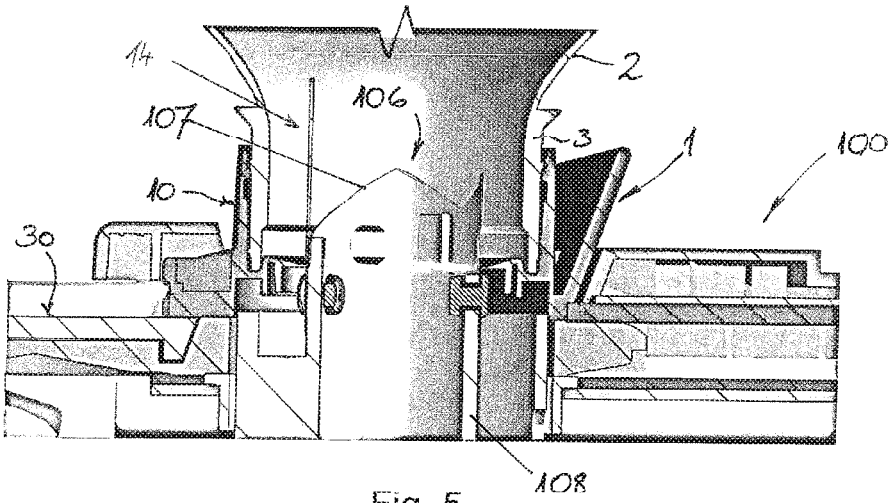
FIG. 5 is a more detailed cross-sectional side view of the bottle closure and dispensing device shown in FIG. 4, with the second closure member in the open position and the cutter in the upper position.
Figure 6:
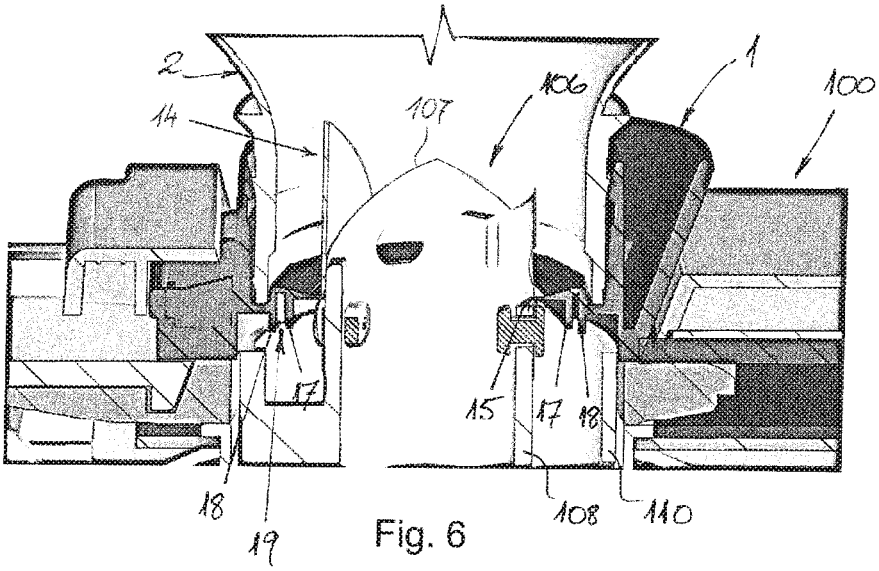
FIG. 6 is a more detailed cross-sectional perspective side view of the bottle closure and dispensing device shown in FIG. 5, with second closure member in the open position and the cutter in the upper position.

(4) While the handle 109 is turned further, the arcuate blade 107 of the cutter 106 moves upwards, thus penetrating the seal 14 (see FIG. 4). Because the blade 107 is not fully circular, but merely horse-shoe shaped (i.e. it circumscribes between about 200° and) 320°, the seal 14 is not completely cut out, but rather is pushed partly up (like a lid of a can) so that a large opening appears.

(5) The ink runs downwards out of the bottle 2 under gravity, mostly through the tubular channel member 108 supporting the blade 107. Ink passing outside the channel member 108 is collected in a second outer channel member 110. The first cap member 10 cooperates with the tubular cutter 106 to form an overlapping (i.e. roof-tile) structure that prevents ink from spilling outside the second outer channel member 110. In drawing FIGS. 5 and 6, the punching or cutting of the seal 14 is shown in more detail. The majority of the ink is drained typically in seconds. The bottle 2 may rest until all remaining ink has been drained. The bottle can optionally remain on the receiving area bay 102 until the next refill is required.

(6) While the actuator lever 109 is in its end position and the seal 14 is punched, a sensor may be activated so that the lever 109 cannot be reversed and the RFID is written as "used." The seal 14 is typically 0.2 mm to 0.6 mm thick and can have a local embossing or a line of weakness 15 to improve cutting. For example, the seal 14 in FIG. 6 may have a local, horse-shoe shaped, thinner section 15 for a more defined cutting of the material. The shape of the blade or knife 107 is optimized for cutting the seal 14 effectively within the available travel of 15 mm to 20 mm and the available force from the mechanism. In this example, the knife 107 has three teeth spaced at 90 degree separations.

(7) When the ink storage reservoir has sufficient space for the next refill (e.g. for a 1 liter refill bottle of ink), the mechanism disabling the device 100 and fixing the bottle 2 in place unlocks. The disabling mechanism is typically the same used to prevent the bottle 2 from being punched at first. The operator can then reverse the lever 109 into its start position. During this movement, the previous sequence is performed in reverse order, such that the bottle 2 and cap 1 can be removed from the adapter 101.

A number of design measures are provided in the cap or closure 1 and a number of measures can be taken to prevent spilling and to inhibit contamination or soiling in an area that the operator may come into contact with. As described above, when the bottle 2 is inserted upside-down into the dispensing device 100, the seal 14 is punctured and ink flows from the bottle 2 under gravity into the storage reservoir.

Firstly, the bottle 2 is fixed in the receiving area 102 so that the seal 14 may only be pierced when the bottle 2 is placed correctly. Secondly, the bottle 2 is removed only after a certain time in which the bottle 2 has drained completely. The slider mechanism 103 of the dispensing device 100 then moves the second cap member 30 of the cap 1 back to the closed position to cover the broken seal 14 after filling the reservoir in order to avoid contact with any remaining ink residue or droplets. Thus, before releasing the bottle 2, the second cap member 30 is shifted back in front of the port cut through the seal 14 in the first cap member 10. This prevents ink droplets and residue on the first cap member 10 from coming into contact with the operator.

Furthermore, because ink residue and droplets inside the neck 3 of the bottle 2 will usually find a way onto an inner surface 33 of the cover element 31 and its mating or contact surface 16 on the first cap member 10, other design measures are also advantageous. Referring to drawing FIG. 7, with an arbitrary shape of the neck 3, the ink could follow a path A. Furthermore, spatter could contaminate or soil part of the internal surfaces of the cap 1 via a path B. This would, in turn, lead to contamination or soiling P on the complementary surfaces 16, 33 between the first and second cap members 10, 30, which could be a hazard to the user.

To this end, the first cap member 10 includes a first lip or rim 17 which extends as an annular collar circumferentially upstanding around the seal 14 to inhibit or prevent migration of ink residue radially outwardly from that lip or rim. The first lip or rim 17 forms a physical barrier to the ink residue or ink droplets accumulating at the outlet port formed through the seal 14 from flowing radially outwards across the cap 1. Furthermore, the first cap member 10 includes a second lip or rim 18 which extends circumferentially around the seal 14 radially outwards from and parallel to the first lip or rim 17 in the manner of a second annular collar. In this way, the second lip or rim 18 cooperates with the first lip or rim 17 to form a trough or channel 19 between them. That trough or channel 19 acts to catch ink migrating radially outwards and to prevent or inhibit such ink migration. These collars 17, 18 also function to provide an overlapping (roof-tile) structure so that the ink is guided downwards into the open channel member 108 that holds the blade 107. After the bulk of the ink has run down, the remainder of the ink slowly drips into the storage reservoir. The collar 17 is tapered or shaped in a sharp way so that the ink drops deliberately remain on this feature, rather than spreading out and causing soiling. For extra spatter protection the second collar 18 is added.

Figure 8:
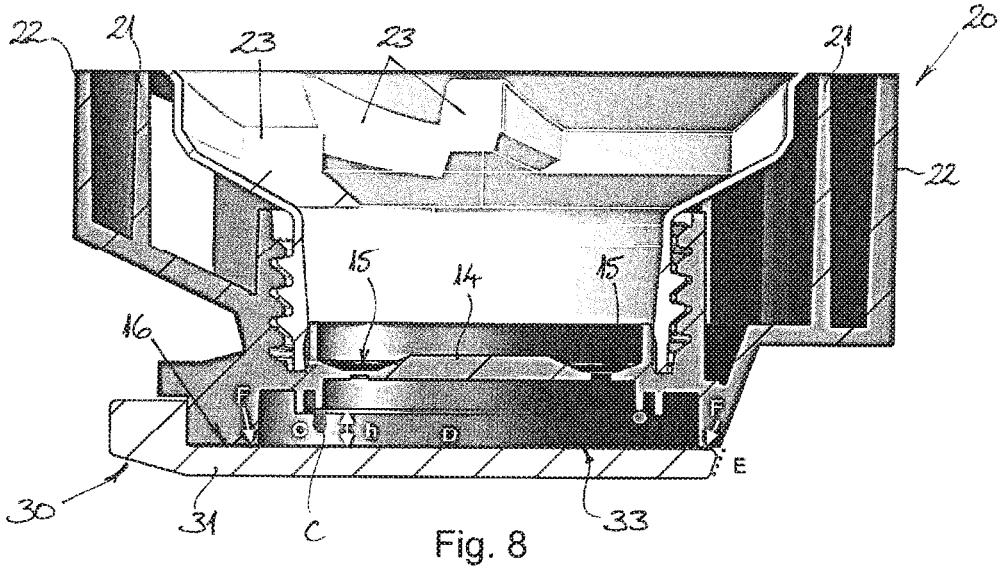
FIG. 8 is a detailed cross-sectional side view of the bottle closure of FIG. 7 with the second closure member in the closed position and showing ink flow paths.

After refilling the storage reservoir, an ink droplet C can be present on the first lip or rim 17, as shown in FIG. 8. In a general case, the droplet could make contact with the inner side 33 of the second cap member 30, when it is moved to the right. This, in turn, would cause soiling of the cap 1, as shown in FIG. 8 by the dotted line D, especially at position E (on the upper and right surface of the flat cover element 31 is FIG. 8). To prevent this, a space or gap h is provided between a free edge of each lip or rim 17, 18 and the inner surface 33 of the second cap member 30, when that cap member 30 is in the closed position. The space or gap h can prevent a droplet of ink residue which collects on the edge of the lip or rim 17, 18 from coming into contact with the second cap member 30, when it is moved back to the closed position to cover the ruptured and contaminated seal 14. The space or gap h is selected to be greater than the typical size of an ink droplet, and is typically in the range of about 5 mm to about 10 mm Thus, by dimensioning the collars in such a way that drops of ink cannot come into contact with the inner surface 33 of the second cap member 30, after draining the ink bottle 2 for a long enough time, only the lips or rims 17, 18 (i.e. collars) may be still wetted by a few droplets. A droplet will have a certain maximum size before it separates and drops off. This will be dependent upon the properties of the ink, such as surface tension and viscosity, and the wetting properties of the plastic cap material. Each collar is dimensioned in such a way that the gap or space h is larger than the maximum size of the droplet. When the slidable cover element 31 is moved back in front of the opening 4, there can be no contact between a droplet and the inside 33 of the cover, thus preventing soiling. A toroidal-shaped projection or lip F may form or act as a seal between the bottle and the cover.

Figure 7:
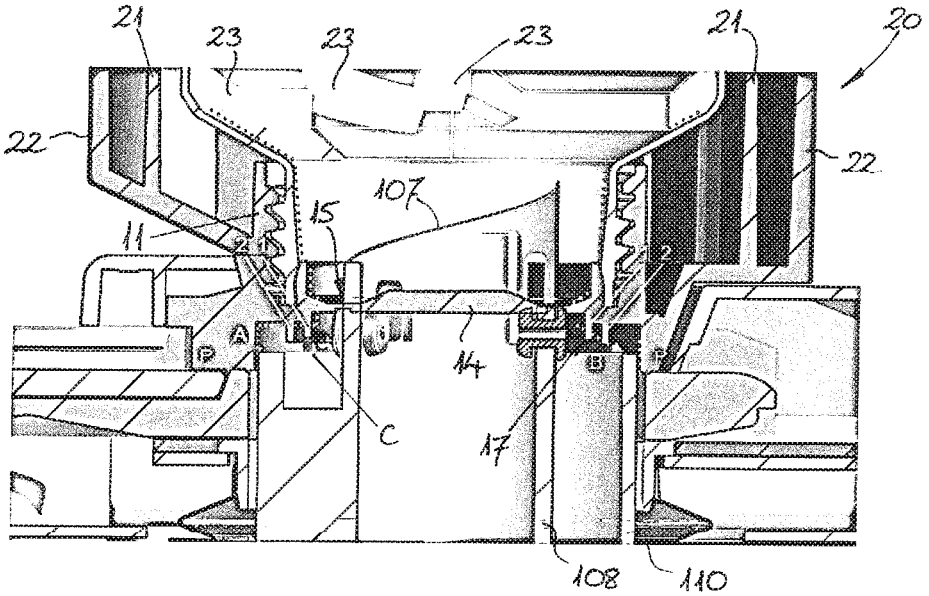
FIG. 7 is a detailed cross-sectional side view of an ink bottle closure of another embodiment on a dispensing device of another embodiment, with the second closure member in the open position and the cutter in the upper position and showing ink flow paths.

Referring further to drawing FIGS. 7 and 8, it will be noted that the cap or closure 1 of the bottle 2 in this embodiment has a connecting portion 11 with a screw thread 12 for interaction with a complementary screw thread 5 provided on the neck 3 of the bottle. Thus, in this embodiment, the respective connecting elements 5, 12 are configured for rotary or threaded engagement with one another. The first cap member 10 includes a skirt portion 20 that depends from and surrounds the connecting portion 11. The skirt portion 20 comprises two approximately cylindrical skirts 21, 22 extending circumferentially around the connecting portion 11. The bottle 2 and the inner cylindrical skirt 21 include complementary locking elements 23 (e.g. flexible webs projecting inward from inner skirt 21 and barbs or notches formed in the neck 3 of the bottle) provided to prevent first cap member 10 from being removed or unscrewed from the bottle 2. The outer skirt element 22 of the skirt portion 20 acts to prevent disengagement or unlocking of the locking elements 23 due to deformation of the skirt portion 20, even upon extreme compression (by hand or by a tool) in the direction of arrows F. In this way, the outer skirt element 22 effectively isolates the inner skirt element 21 from a manual deforming force F applied by an operator.

Although specific embodiments of the invention are illustrated and described herein, it will be appreciated by those of ordinary skill in the art that a variety of alternate and/or equivalent implementations exist. It will be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF REFERENCE SIGNS

1 closure or cap
2 bottle
3 neck
4 outlet opening
5 connecting element
6 upper rim

7 sealing bead
8 longitudinal or central axis
10 first closure member or first cap member
11 connecting portion
12 connecting element or lug
13 connecting element or recess
14 seal
15 local embossing or line of weakness
16 contact surface
17 first lip or rim or collar
18 second lip or rim or collar
19 trough or channel
20 skirt portion
21 first skirt
22 second skirt
23 locking element
30 second closure member or second cap member
31 flat cover element
32 projection or ridge
33 inner surface of cover
100 dispensing device
101 adapter
102 receiving area
103 slider mechanism
104 recess
105 tray
106 cutter
107 blade
108 channel member
109 actuator or lever
110 second channel member The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system comprising:

an ink bottle closure comprising:

a first closure member configured to be fixed to an ink bottle, the first closure member including a seal, arranged to be located over an outlet opening in a neck of the bottle; and a second closure member attached to the first closure member and movable relative to the first closure member between a closed position, in which the second closure member covers the seal, and an open position in which the seal is exposed to be pierced or ruptured for dispensing ink from the bottle through the outlet opening, wherein the second closure member is movable in translation, relative to the first closure member between the closed position and the open position in a direction substantially perpendicular to a central or longitudinal axis of the bottle; and a dispensing device for opening an ink bottle closure, comprising:

an adapter having a receiving area for receiving the ink bottle closure of an ink re-fill bottle with the bottle in an inverted orientation;

a mechanism for moving the second closure member relative to the first closure member from a closed position, in which the second closure member covers the seal, to an open position in which the seal is exposed; and a cutter arranged below the adapter substantially aligned with the receiving area, wherein the cutter is movable generally vertically between a lower position, in which the cutter is retracted from interaction with the ink bottle closure, and an upper position in which the cutter pierces or ruptures the exposed seal to dispense ink from the bottle.

2. The system according to claim 1, wherein the cutter of the dispensing device comprises a cutting blade provided on or arranged in a channel member defining a fluid path for flow of ink from the bottle into an ink storage reservoir of the printer or copier, and wherein the cutting blade has an arcuate cross-section generally corresponding to a shape or form of the channel member.

3. The system according to claim 1, comprising a controller for enabling or disabling movement of the mechanism and/or movement of the cutter in dependence on identification data from the ink bottle, the controller being configured to detect and read an RFID chip storing data which identifies one or more characteristics of an ink contained in the bottle.

4. The system according to any of claim 1, further including an actuator for manual actuation by an operator to activate movement of the mechanism and/or the cutter, wherein the controller is configured to enable and/or to disable the actuator.

5. The system according to any of claim 1, wherein the seal comprises an element integrally formed in the first closure member.

6. The system according to any of claim 1, wherein the first closure member of the ink bottle closure includes a first lip or rim which extends circumferentially upstanding around the seal to inhibit migration of ink residue radially outwardly from said lip or rim.

7. The system according to any of claim 6, wherein, when the second closure member of the ink bottle closure is in the closed position, a space or gap (h) is provided between the first lip or rim of the first closure member and an inner surface of the second closure member, and wherein the space or gap (h) is at least 2 mm.

8. The system according to any one of claim 6, wherein the first closure member of the ink bottle closure further includes a second lip or rim which extends circumferentially upstanding around the seal located radially outwards from the first lip or rim for inhibiting migration of ink radially outwards.

9. The system according to any one of claim 1, wherein the first closure member of the ink bottle closure comprises a connecting portion configured for fixing the first closure member to the bottle, the connecting portion having connecting elements for interaction with complementary connecting elements on the bottle, the connecting elements being configured for a snap-fit engagement, or for a rotary engagement with the complementary connecting elements.

10. The system according to claim 9, wherein the first closure member of the ink bottle closure includes a skirt portion that depends from and/or at least partially surrounds the connecting portion, wherein the skirt portion comprises at least one skirt, extending circumferentially around the connecting portion.

11. The system according to claim 1, wherein the second closure member of the ink bottle closure comprises a cover element which is mounted on or attached to the first closure member for sliding movement between the open and closed positions.

12. The system according to claim 1, wherein the seal comprises an element integrally formed in the first closure member which defines a port for dispensing ink from the bottle, wherein the seal defines a region, which is configured to be cut, pierced or ruptured to open the port, the first closure member being a moulded plastic component.

13. The system according to claim 4, wherein the actuator is a lever or button.

14. A kit, comprising:

the system according to claim 1; and an ink bottle.

15. The kit according to claim 14, wherein the ink bottle comprises an RFID chip for storing data identifying one or more characteristics of an ink contained in the bottle.

16. The kit according to claim 15, wherein the one or more characteristics of the ink includes at least one of type, colour, and expiry date of the ink.

* * * * *